US008251181B2

(12) United States Patent
Schapiro

(10) Patent No.: US 8,251,181 B2
(45) Date of Patent: Aug. 28, 2012

(54) LADDER SAFETY DEVICE

(76) Inventor: Edward Schapiro, Boca Raton, FL (US)

( * ) Notice: Subject to any disclaimer, the term of this patent is extended or adjusted under 35 U.S.C. 154(b) by 181 days.

(21) Appl. No.: 12/806,129

(22) Filed: Aug. 5, 2010

(65) Prior Publication Data

US 2011/0042166 A1 Feb. 24, 2011

Related U.S. Application Data

(60) Provisional application No. 61/273,587, filed on Aug. 5, 2009.

(51) Int. Cl.
*E04G 1/00* (2006.01)

(52) U.S. Cl. ..... 182/129; 182/230

(58) Field of Classification Search ..... 182/129
See application file for complete search history.

(56) References Cited

U.S. PATENT DOCUMENTS

| | | | | | |
|---|---|---|---|---|---|
| 2,162,022 | A * | 6/1939 | Mansfield | 248/210 |
| 2,518,107 | A * | 8/1950 | Wilson | 182/194 |
| 2,672,182 | A * | 3/1954 | Gwin et al. | 108/90 |
| 3,013,627 | A * | 12/1961 | Embrey, Jr. | 182/106 |
| 3,891,053 | A * | 6/1975 | Burton | 182/97 |
| 4,262,834 | A * | 4/1981 | Nutt | 224/324 |
| 4,480,810 | A * | 11/1984 | Hall | 248/238 |
| 4,798,264 | A * | 1/1989 | Miller et al. | 182/230 |
| 5,094,319 | A * | 3/1992 | Kobasic | 182/121 |
| 5,191,954 | A * | 3/1993 | Ledford | 182/129 |
| D372,989 | S * | 8/1996 | Gile et al. | D25/68 |
| 5,673,885 | A * | 10/1997 | Pham | 248/210 |
| 5,727,649 | A * | 3/1998 | Buckley | 182/129 |
| 6,357,706 | B1 * | 3/2002 | Fleckenstein | 248/210 |
| 6,361,003 | B1 * | 3/2002 | Keoun | 248/213.2 |
| 6,364,057 | B1 * | 4/2002 | Cornejo et al. | 182/106 |
| 6,415,890 | B1 * | 7/2002 | Tucker et al. | 182/129 |
| 6,698,548 | B1 * | 3/2004 | Verrill | 182/129 |
| 6,994,185 | B1 * | 2/2006 | Hertel | 182/129 |
| 7,374,018 | B1 * | 5/2008 | Thrun | 182/129 |
| 8,016,075 | B2 * | 9/2011 | Pohl | 182/129 |
| 2002/0189902 | A1 * | 12/2002 | Nelson | 182/129 |
| 2005/0211502 | A1 * | 9/2005 | LaBrash | 182/127 |
| 2005/0258002 | A1 * | 11/2005 | Sabo | 182/129 |
| 2006/0207021 | A1 * | 9/2006 | Brunson et al. | 5/81.1 R |
| 2007/0205054 | A1 * | 9/2007 | Gentles et al. | 182/230 |
| 2010/0219017 | A1 * | 9/2010 | Inman | 182/107 |
| 2011/0005863 | A1 * | 1/2011 | Thurner | 182/129 |
| 2011/0297482 | A1 * | 12/2011 | O'Brien et al. | 182/129 |

* cited by examiner

*Primary Examiner* — Katherine W Mitchell
*Assistant Examiner* — Candace L Bradford
(74) *Attorney, Agent, or Firm* — Robert M. Downey, P.A.

(57) ABSTRACT

A portable safety device locks onto a step of a ladder to provide cushioning for the legs and to prevent the user from tipping the ladder sideways. The device comprises a center component connected to two U-shaped leg braces, a closeable handle, and a retractable clamp. The retractable clamp is extended when the closeable handle is opened and retracted when the closeable handle is closed. In the retracted position, the clamp securely grasps the front and rear edges of a selected step on the ladder to effectively attach the device to the ladder in an operable position. The two leg braces partially surround the user's lower legs, between the ankle and the knee, and include a cushion material for added comfort when the user's legs lean against the braces. The leg braces attach to the center component by locking into a horizontal track which allows the braces to be separated or brought together to adjust for the user's natural stance and leg separation. The leg braces help to stabilize the user when standing on the ladder and discourage the user from leaning dangerously too far to either side of the ladder, thereby preventing the ladder from tipping and possibly injuring the user.

3 Claims, 5 Drawing Sheets

LADDER SAFETY DEVICE

This application is based on provisional patent application Ser. No. 61/273,587 filed on Aug. 5, 2009.

BACKGROUND OF THE INVENTION

1. Field of the Invention

The present invention relates to safety devices for ladders and, more particularly, to a portable safety device that removably mounts to a rung or step on a ladder and which includes a pair of adjustably positionable cushioned leg braces for stabilizing a person when standing on the ladder.

2. Discussion of the Related Art

Many people who use ladders lean against the ladder for two reasons. First, the space of working area for someone using a ladder is very limited, so they may lean to the sides (i.e., to the left and/or right) in order to reach areas quicker than by getting down, moving the ladder, and climbing back up. Second, users tend to lean against the ladder for stability and to more easily keep their balance. This causes two problems. First, users who lean forward have their legs leaning against one of the steps of the ladder, which over a length of time can cause discomfort, particularly at the shins. Second, users who reach too far to either side of the ladder sometimes shift their center of gravity so far that it suddenly causes the ladder to tip to the side, throwing the user to the ground. This can cause serious injury or even death in certain scenarios.

In the past, others have proposed various padded devices for engaging a person's legs while leaning forward on a ladder. Some of these devices attach directly to the steps of the ladder, while others are adjustably positionable along the length of the vertical legs of the ladder. Examples of these devices are found in the U.S. Patents to Perrett, U.S. Pat. No. 6,729,438; Tucker et al., U.S. Pat. No. 6,415,890; and Gile et al., U.S. Pat. No. D372,989. The numerous devices proposed in the related art are generally effective for their intended purpose, which is to provide comfort against the user's legs when leaning forward on a ladder. Notwithstanding, the proposed devices in the related art fail to provide a means for stabilizing a person while standing on a ladder so that the person does not dangerously lean to either side when attempting to perform a particular task. In addition, the proposed devices in the related art fail to provide a combination of leg cushioning and stability with small size and portability.

Objects and Advantages of the Invention

Considering the foregoing, it is a primary object of the present invention to provide a safety device for use on a ladder, and wherein the device is particularly adapted to discourage a user standing on a ladder from leaning dangerously to either side of the ladder, thereby preventing misuse of the ladder and possible injury.

It is a further object of the present invention to provide a safety device for use on a ladder which comfortably engages the user's legs and stabilizes the user while standing on a ladder so that the user does not have to struggle to maintain balance, thereby preventing fatigue of the leg muscles.

It is still a further object of the present invention to provide a safety device for use on a ladder, and wherein the device includes a pair of generally U-shaped braces that are adjustably positionable so that the separation between the leg braces can be adjusted to accommodate the needs of the particular user.

It is still a further object of the present invention to provide a safety device for use on a ladder which forces the user to step down and move the ladder when necessary, thereby preventing misuse and possible injury.

It is still a further object of the present invention to provide a safety device for use on a ladder, and wherein the device includes a pair of generally U-shaped leg braces that partially surround the user's legs and comfortably stabilize the user while standing on a ladder.

It is yet a further object of the present invention to provide a safety device for a ladder, as described above, which is easy to assemble and install on a ladder.

It is yet a further object of the present invention to provide a safety device for a ladder, as described above, which is easily attached and removed from any selected step of a step ladder.

It is yet a further object of the present invention to provide a safety device for a ladder, as described above, which is easily carried, transported and stowed due to its small size and carry handle.

These and other objects and advantages of the invention are more readily apparent with reference to the detailed descriptions and drawings.

SUMMARY OF THE INVENTION

The present invention is directed to a safety device for use on a ladder. The safety device includes a pair of adjustably positionable U-shaped leg braces attached to a horizontal track on a center component. The leg braces partially surround the user's lower legs, between the ankle and the knee, and include a cushion material for added comfort when the user's legs lean against the braces. The leg braces help to stabilize the user when standing on the ladder and discourage the user from leaning dangerously to either side of the ladder, thereby preventing misuse of the ladder and possible injury. A handle is attached to the center component for carrying the device. The handle may rotate from a closed position to an open position. A retractable clamp is also connected to the center component and is mechanically connected to the handle in such a way that when the handle is in the closed position, the clamp remains retracted, and when the handle is put into the open position, the clamp extends. This mechanism allows the clamp to be extended over a selected rung or step of a ladder and then retracted to lock the device onto the step.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

Detailed Description of the Preferred Embodiment

Figure 1:
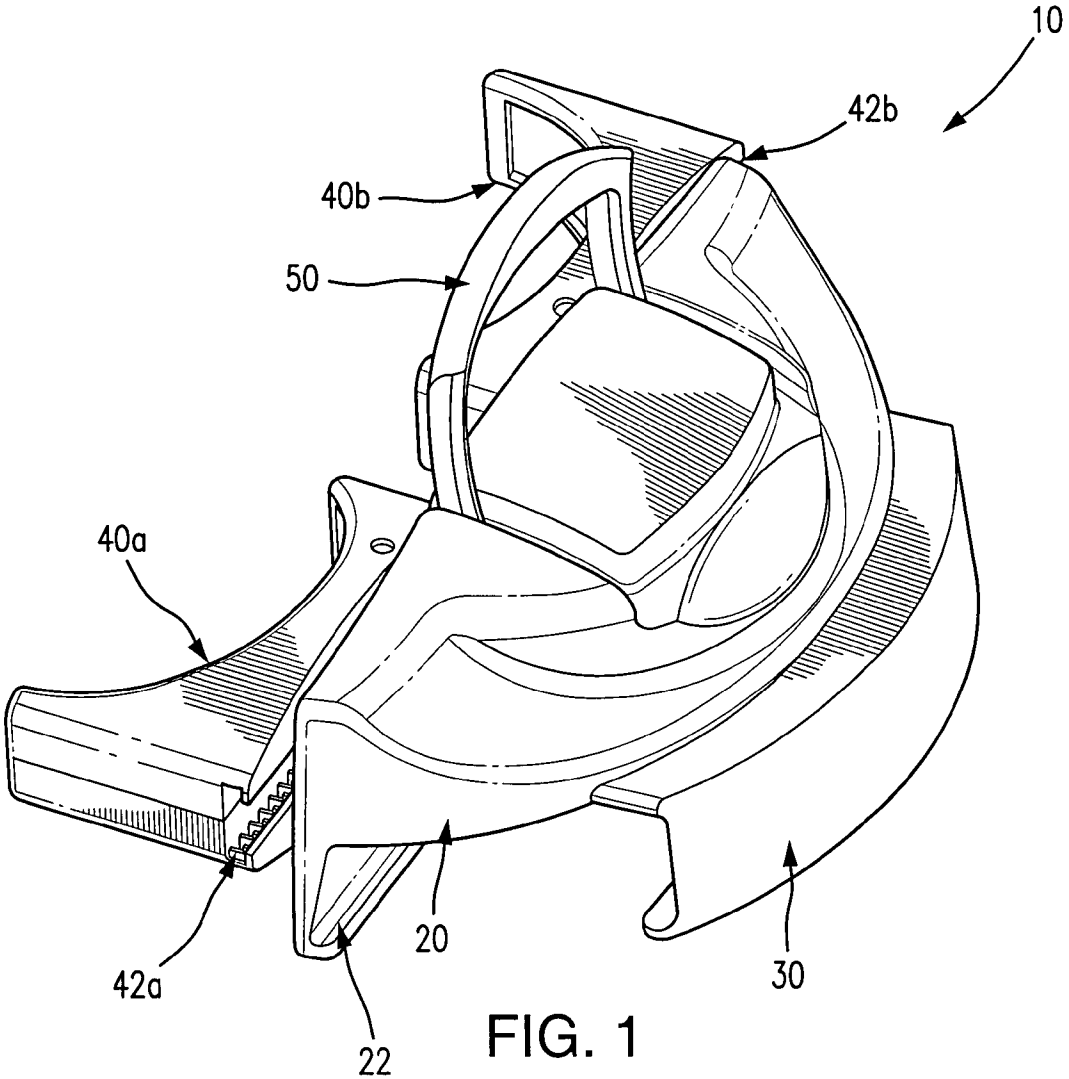
FIG. 1 is a front, side perspective view of the ladder safety device of the present invention in the open position.
Figure 2:
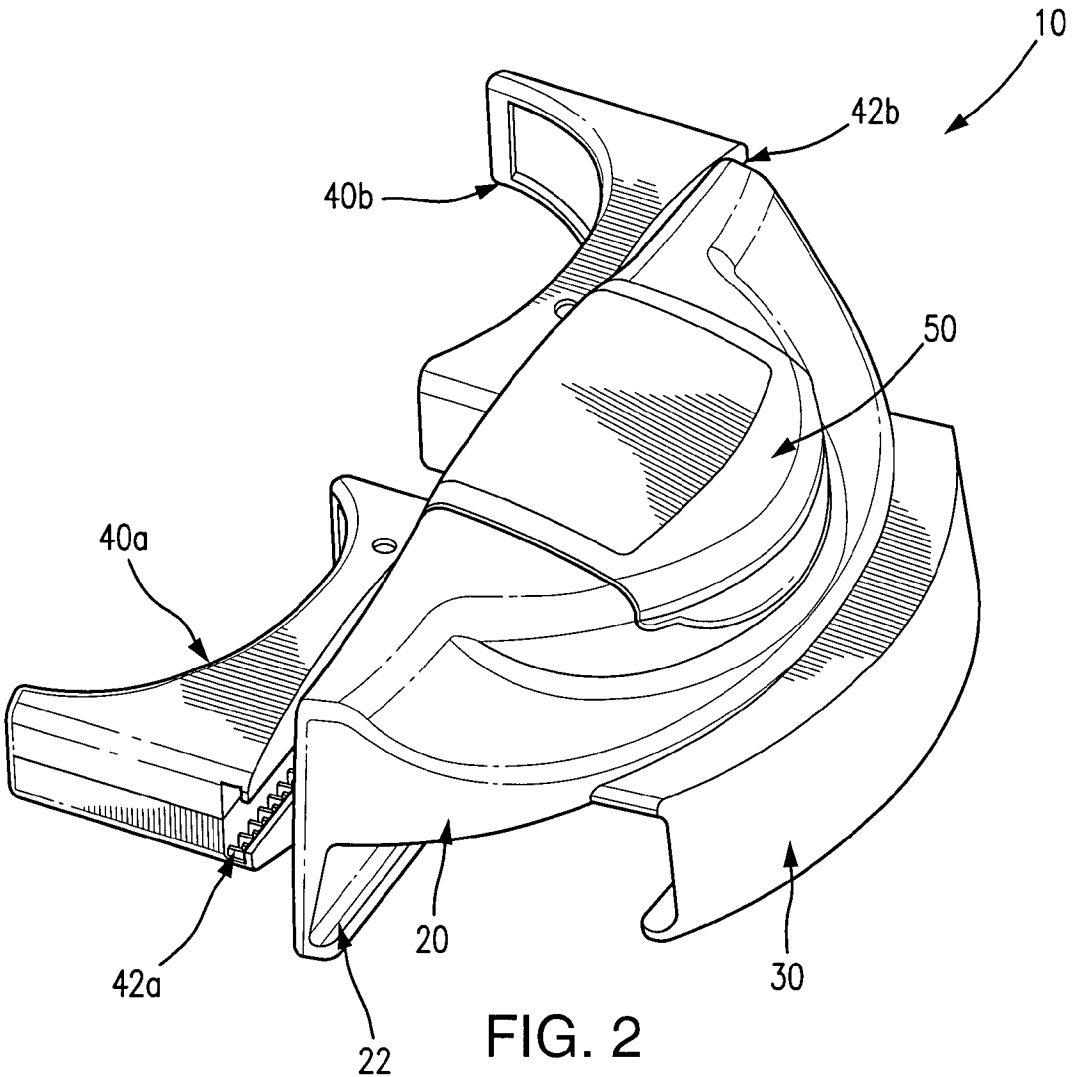
FIG. 2 is a front, side perspective view of the ladder safety device of the present invention in the closed position.

Referring to the several views of the drawings, and initially FIGS. 1-2, the ladder safety device of the present invention is shown and is generally indicated as 10.

The safety device 10 includes a center component 20, a pair of U-shaped leg braces 40*a* and 40*b*, a retractable clamp 30 and a handle 50. The braces 40*a* and 40*b* are adjustably positionable along their tracks 42*a* and 42*b*, respectively, in relation to the center component. The braces 40*a* and 40*b* are fitted with a cushion material to provide comfortable engagement against the user's legs, and particularly the shins. The handle 50 is operable between an open position as shown in FIG. 1 and a closed position as shown in FIG. 2. Correspondingly to the handle's position, the retractable clamp 30 is operated between an extended position as shown in FIG. 1 and a retracted position as shown in FIG. 2. The handle 50 and clamp 30 are mechanically connected within the center component 20 in such a way that movement of the handle serves to operate the clamp 30 between the extended position and the retracted position. Specifically, when the handle 50 is moved from the closed position to the open position, the clamp 30 will move from the retracted position to the extended position.

Figure 3:
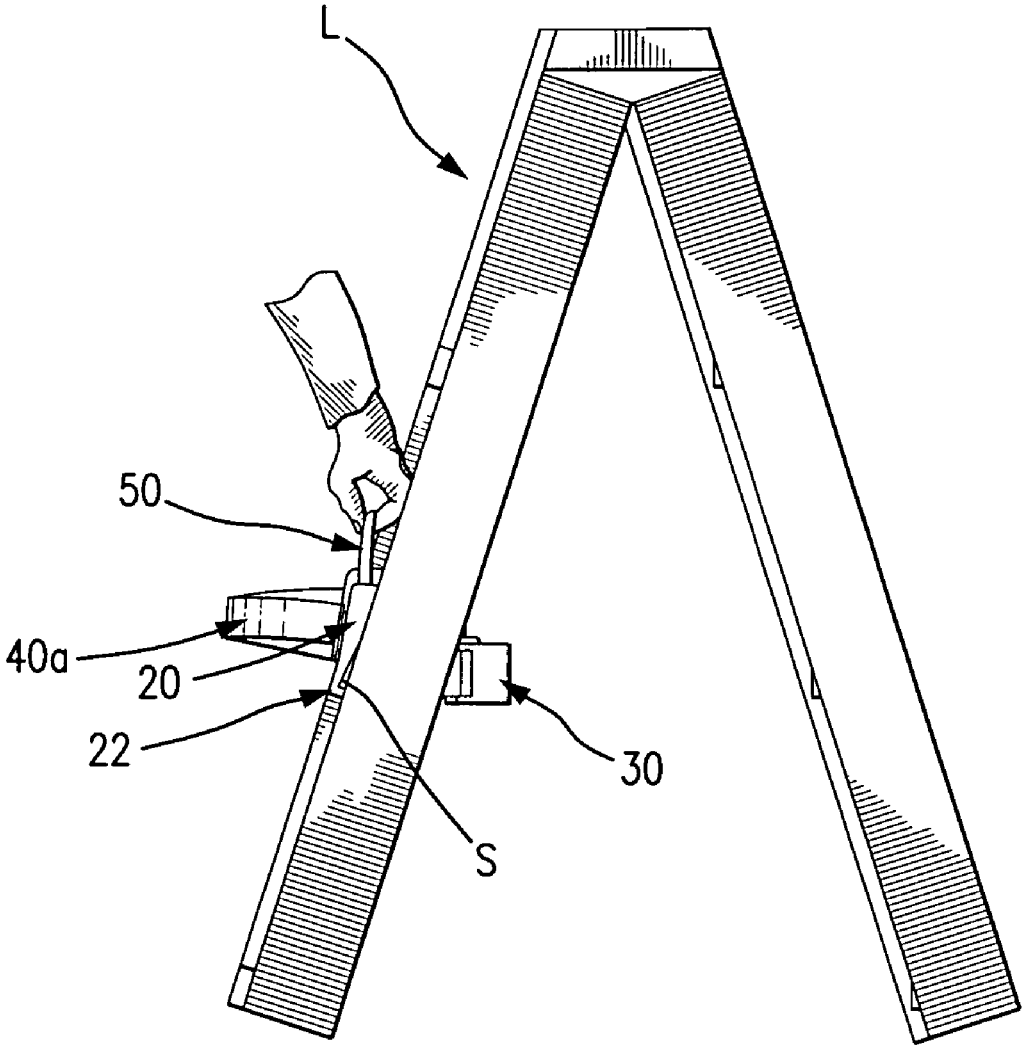
FIG. 3 is a side elevational view of the ladder safety device of the present invention in the closed position being attached to a step of a ladder.

FIG. 3 shows the device 10 being attached to ladder L. Device 10 is fitted over a selected step S of ladder L while the clamp 30 is in the extended position. Once clamp 30 and bottom clip 22 are seated in surrounding relation to the step S, handle 50 is closed and clamp 30 is retracted. This action locks the device 10 in place due to the inward force created by the retracted clamp 30 and the bottom clip 22 of center component 20. Specifically, the retracted clamp 30 and bottom clip 22 securely grasp the respective rear and front edges of the step S to effectively lock the device 10 on the ladder L. Once locked in, the device 10 is ready for use.

Figure 4:
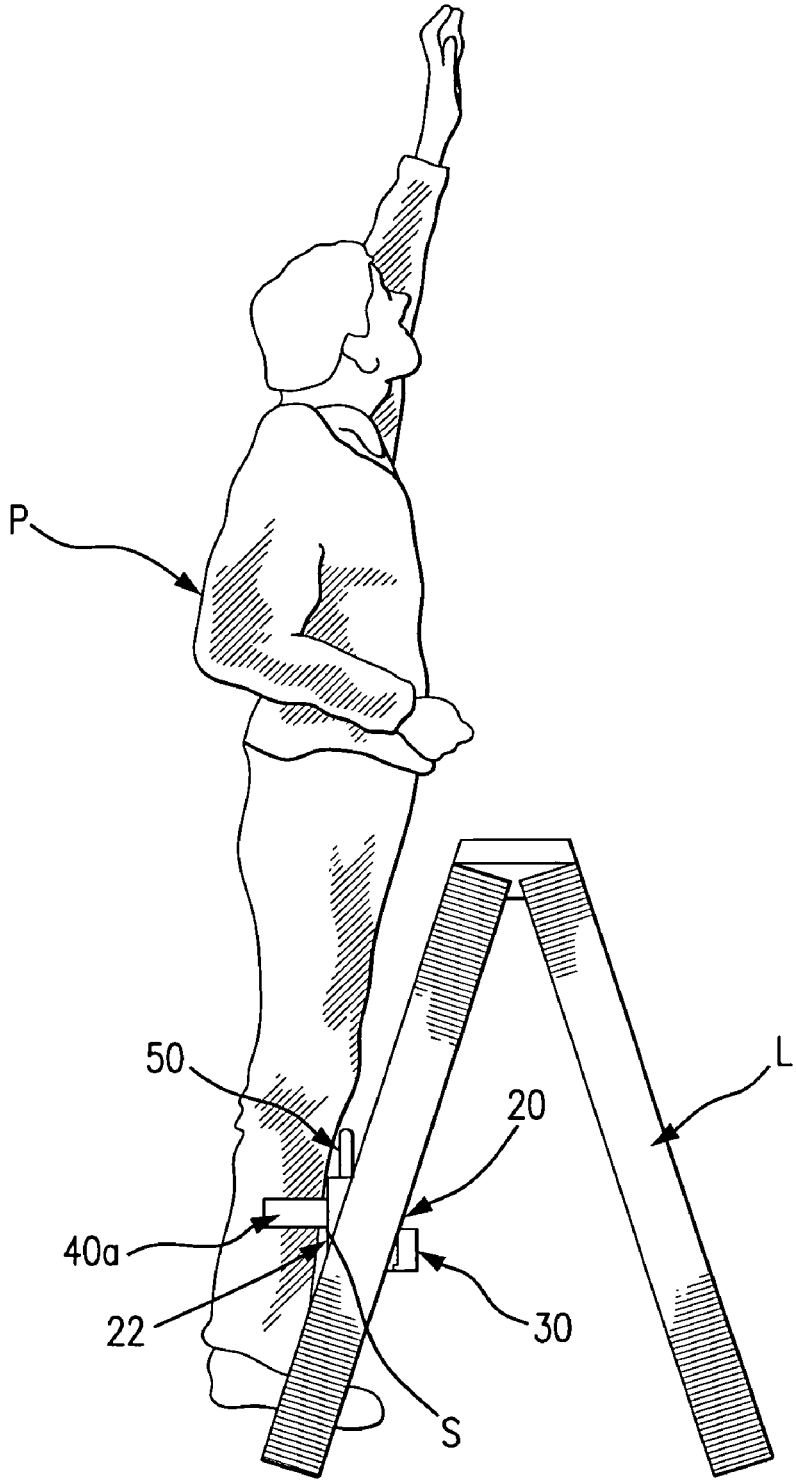
FIG. 4 is a side elevational view of the ladder safety device of the present invention locked onto a step of a ladder in the closed position with a person using the device.
Figure 5:
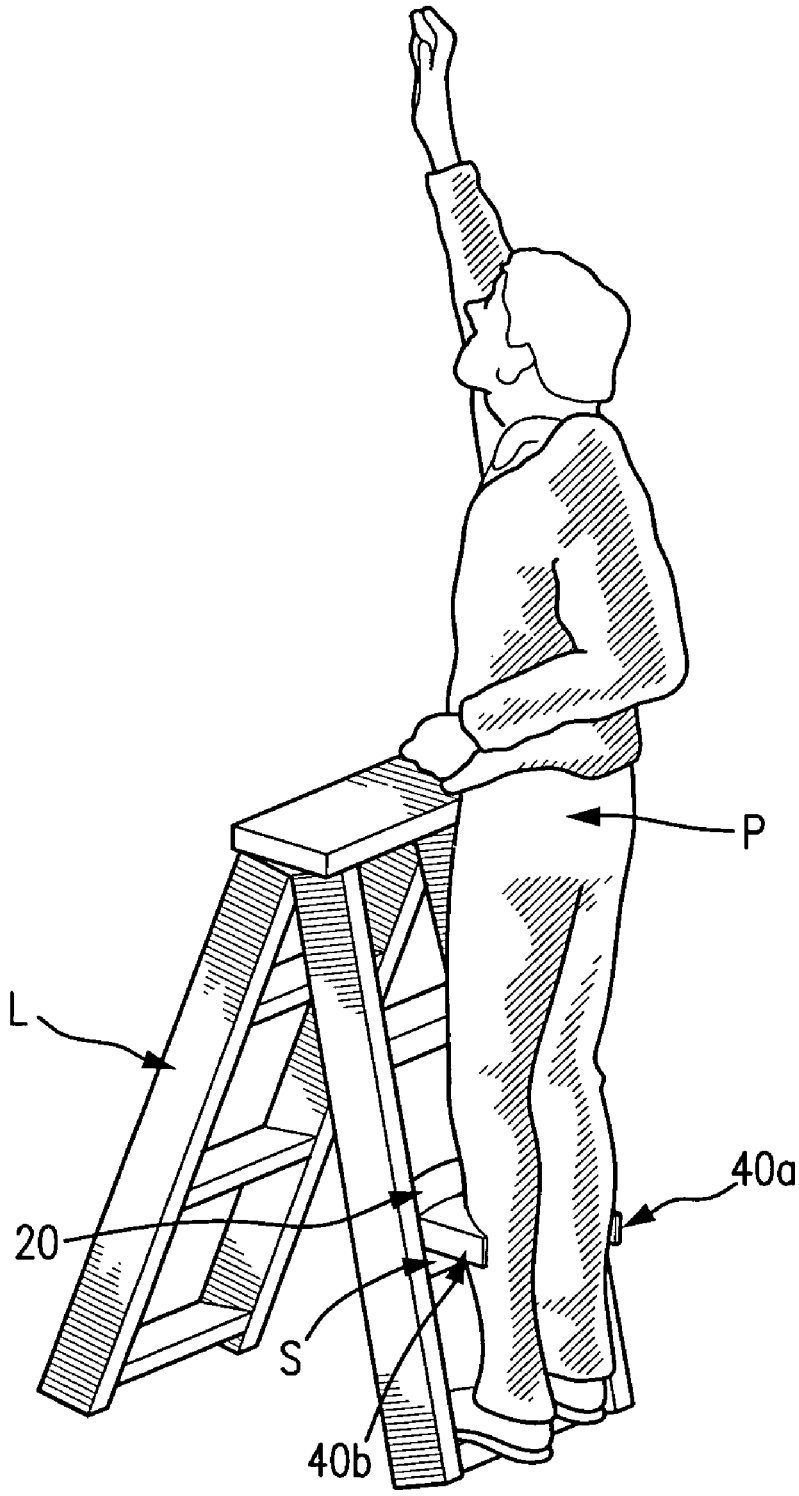
FIG. 5 is a rear, side perspective view of the ladder safety device of the present invention locked onto a step of a ladder in the closed position with a person using the device.

FIGS. 4-5 show the ladder safety device 10 installed on a step S of a ladder L with a person P standing on another step below the device 10 so that the leg braces 40*a*, 40*b* engage the lower legs of the person P. As seen in FIGS. 4-5, the leg braces 40*a*, 40*b* wrap around the front and sides of the person's P legs to stabilize the person P on the ladder L. This forces the user P of the ladder L to step down from and reposition the ladder L as necessary, rather than attempting to lean and dangerously reach to the sides which could result in tipping of the ladder L and/or the person P falling to the ground. And, while the example in FIGS. 4-5 shows a step ladder L, it is noted that the device 10 is intended for use on other types of ladders, including extension ladders. The structure of the device 10 remains the same, regardless of ladder type.

Accordingly, the safety device 10 of the present invention provides for comfort, stability and peace of mind when standing on a ladder, while reducing leg muscle fatigue as well as the potential of injury due to misuse of the ladder.

While the present invention has been shown and described in accordance with a preferred and practical embodiment thereof, it is recognized that departures from the instant disclosure are fully contemplated within the spirit and scope of the invention.

What is claimed is:

1. A ladder safety device for removable attachment to a ladder step having a first edge and an opposite second edge, and said ladder safety device comprising:

a center component having a bottom clip structured and configured to engage the first edge of the ladder step;

a first U-shaped leg brace connected to said center component, said first U-shaped leg brace being structured and disposed for receiving a portion of a user's first leg;

a second U-shaped leg brace connected to said center component, said second U-shaped leg brace being structured and disposed for receiving a portion of a user's second leg;

a retractable clamp connected to said center component and being structured for engaging the opposite second edge of the ladder step, and said retractable clamp and said bottom clip being cooperatively structured and disposed for releasably grasping the oppositely disposed first and second edges of the ladder step, and said retractable clamp being selectively positionable between an extended position relative to said bottom clip for placement and removal of said ladder safety device onto and from the ladder step, and a retracted position relative to said bottom clip for securing said ladder safety device to the ladder step with said bottom clip and said retractable clamp disposed in grasping engagement with the respective opposite first and second edges of the ladder step; and a closeable handle connected to said center component, said closeable handle being operable between an open and closed position, and said closeable handle being connected to said retractable clamp, wherein movement of said closeable handle to the open position moves said retractable clamp outwardly to the extended position and movement of said closeable handle to the closed position moves said retractable clamp inwardly to the retracted position.

2. The ladder safety device as recited in claim 1 wherein said first and second U-shaped leg braces include a cushion material for supporting the portion of the user's first and second legs.

3. The ladder safety device as recited in claim 1 wherein said first and second U-shaped leg braces are adjustably positioned along a track connected to said center component.

* * * * *